US005574358A

United States Patent [19]

Garrett

[11] Patent Number: 5,574,358

[45] Date of Patent: Nov. 12, 1996

[54] SHUTDOWN CIRCUIT AND BATTERY PACK USING SAME

[75] Inventor: Scott M. Garrett, Lawrenceville, Ga.

[73] Assignee: Motorola, Inc., Schaumburg, Ill.

[21] Appl. No.: 354,340

[22] Filed: Dec. 12, 1994

[51] Int. Cl.[6] ..... G05F 1/569

[52] U.S. Cl. ..... 323/276

[58] Field of Search ..... 323/273, 274, 323/276, 277, 266, 274

[56] References Cited

U.S. PATENT DOCUMENTS

| | | | |
|---|---|---|---|
| 3,541,425 | 6/1968 | Weidmann | 323/273 |
| 3,597,657 | 8/1971 | Fredricsson | 361/74 |
| 3,886,410 | 5/1975 | Seer, Jr. | 323/276 |
| 3,919,601 | 11/1975 | Suko et al. | 361/100 |
| 4,972,136 | 11/1990 | Banura | 323/275 |

*Primary Examiner*—Matthew V. Nguyen
*Assistant Examiner*—Adolf Berhane
*Attorney, Agent, or Firm*—Scott M. Garrett

[57] ABSTRACT

A current limited linear regulator including a pass transistor 56 is provided with a shutdown circuit 64 comprised of a shutdown transistor 90, base resistor 92, and zener diode 98. When a excessive load is placed on the regulator and the current level limit is reached, the output voltage begins to drop and the voltage drop V2 across the pass transistor 56 increases. When the voltage drop V2 across the pass transistor 56 is equivalent to the sum of the zener voltage of the zener diode 98 and the emitter-base junction bias voltage of the shutdown transistor 90, the transistor 90 switches a current into bias resistor 62 that prevents the control circuit from regulating the output, causing the pass transistor to become highly resistive and shut off. The shutdown circuit holds this condition until the offending load is effectively removed. The zener diode is chosen according to the power rating of the pass transistor 56 and the predetermined current level limit.

15 Claims, 4 Drawing Sheets

SHUTDOWN CIRCUIT AND BATTERY PACK USING SAME

TECHNICAL FIELD

The invention relates in general to regulators, and more particularly to current limited regulators.

BACKGROUND

Linear regulation is a well known technique for producing a stable DC voltage from a raw, or unregulated DC supply. The unregulated supply could be, for example, a rectified and filtered AC source or an electrochemical battery. The unregulated supply must have a voltage higher than the intended output of the regulator since only a lower voltage can be produced using linear techniques. Additionally, the current output of the regulator may be limited as a safety measure, or to avoid damaging a sensitive electronic device connected to the regulator.

Linear regulators have two main components; a pass device and a feed back control circuit. The pass device is typically a transistor which is electrically located in series between the unregulated supply and the load. Current delivered to the load passes through the transistor, and is regulated by the control circuit. In this sense, the transistor acts as a variable resistor, and the effective resistance is controlled by the control circuit such that output voltage is maintained at a predetermined level. If the load is a time varying load, then the control circuit causes the pass transistor to vary linearly with the load.

One of the chief obstacles to overcome when using linear regulation techniques is power dissipation. The power dissipated by the pass transistor is the product of the difference between the unregulated voltage input and the output voltage, and the current through the device; that is, $(V_{in}-V_{out})\cdot I_{load}$. With regulators that are not current limited, the pass transistor may burn out if load demand is excessive. Providing a current limit action with the regulator can eliminate this threat in some systems, but in smaller systems, such as in battery powered portable electronics, the limited space available restricts the use of for example, a heat sink.

Pass transistor power dissipation is especially pertinent in portable electronic devices operated in volatile atmospheric conditions. These devices must be constructed so that even under extreme failure conditions the device will not ignite the surrounding atmosphere. Examples of applications where such safety measures are required include mining, grain processing, and chemical manufacturing facilities. Electronics operated in these areas must neither allow a sufficiently energetic spark to occur, nor may any exposed surface be heated to an unsafe temperature. In portable systems using rechargeable battery packs, the battery is a significant potential ignition source. The output of the battery is often regulated so as to limit the voltage, current, and total power available to the device. Since linear regulators are fairly simple, they lend themselves to the design of safe devices, provided that the heat issue is addressed.

Accordingly, there is a need to keep the pass transistor from over heating, and creating a potentially unsafe condition. However, since the space available in such systems is very limited, a means other than a heat sink is desirable to limit the power dissipation of the pass transistor. One such method is to provide a regulator. FIG. 1 illustrates a circuit diagram of a typical regulator according to the prior art. Unregulated DC source 10 provides a raw voltage and current Io to be delivered to load 12. The current passes through sense resistor 24 and pass transistor 18, which may be either a MOSFET or a bipolar transistor, as illustrated. Control circuit 22 is provided to control pass transistor 18 such that the output voltage V1 is constant and output current level Io is limited to a predetermined limit. As a result, there is a voltage drop V2 across pass transistor 18. Additionally, sense resistor 24 produces voltage drop V3 proportional to current through it.

Voltage drop V3 is fed to control circuit 22 via line 26 as a feed back signal. Control circuit 22 is resistively coupled to pass transistor 18 by resistor 28 and controls the effective resistance of pass transistor 18 to achieve the desired output voltage level so long as current level Io is below the predetermined limit. Should the current level reach the limit, control circuit 22 will cause V1 to drop until the demand of load 12 diminishes to agree with the limited output current level. Should the output be shorted by a conductor, the output voltage drops to zero, causing all of the source voltage to be evident across pass transistor 18, and the output current rises the limit level.

Once the current limit is reached and V1 begins to drop, voltage across pass transistor 18 increases. Since current Io is limited to a preset limit, when output voltage V1 drops, the power dissipation of pass transistor 18 rises proportionally as V2 increases. To keep pass transistor 18 from burning up, a shutoff circuit has been included. The shutoff circuit is comprised of transistor pair 39, arranged in a darlington configuration, capacitor 32, and resistor 34. As V2 increases, capacitor 32 begins charging at a rate controlled by resistor 84, which is quite large in value to achieve a delay effect. If the magnitude of voltage drop V2 is sufficient and lasting, the voltage across capacitor 32 will be enough to trigger transistor pair 30 to switch current into the bias leg of pass transistor 18. This current overwhelms the effect of control circuit 22 and pass transistor 18 turns off. A darlington pair configuration is used to overcome the effect that resistor 34 would have on a single switch transistor which has a much lower gain than the darlington pair 30.

The problem with the circuit illustrated in FIG. 1 is that the maximum sustained V2 cannot exceed the trigger voltage of transistor pair 80. The equivalent power dissipation of pass transistor 18 when this trigger voltage is evident across pass transistor 18 is typically well below its power rating, even at maximum current output. Also, should DC source 10 increase to a voltage higher than the pre-selected output voltage of the regulator by more than the trigger voltage of darlington pair 30, the regulator will be shut off. This is easily possible in a battery powered system where the battery is being recharged and the battery voltage rises to a level beyond its maximum non-charging voltage.

Therefore, there exists a need for a circuit in which a regulator can allow a sustained voltage drop across it's pass transistor so long as the resulting voltage drop does not cause excessive power dissipation. The circuit should also shut off the pass transistor should the voltage across it cause excessive power dissipation.

DETAILED DESCRIPTION OF THE PREFERRED EMBODIMENT

Figure 1:
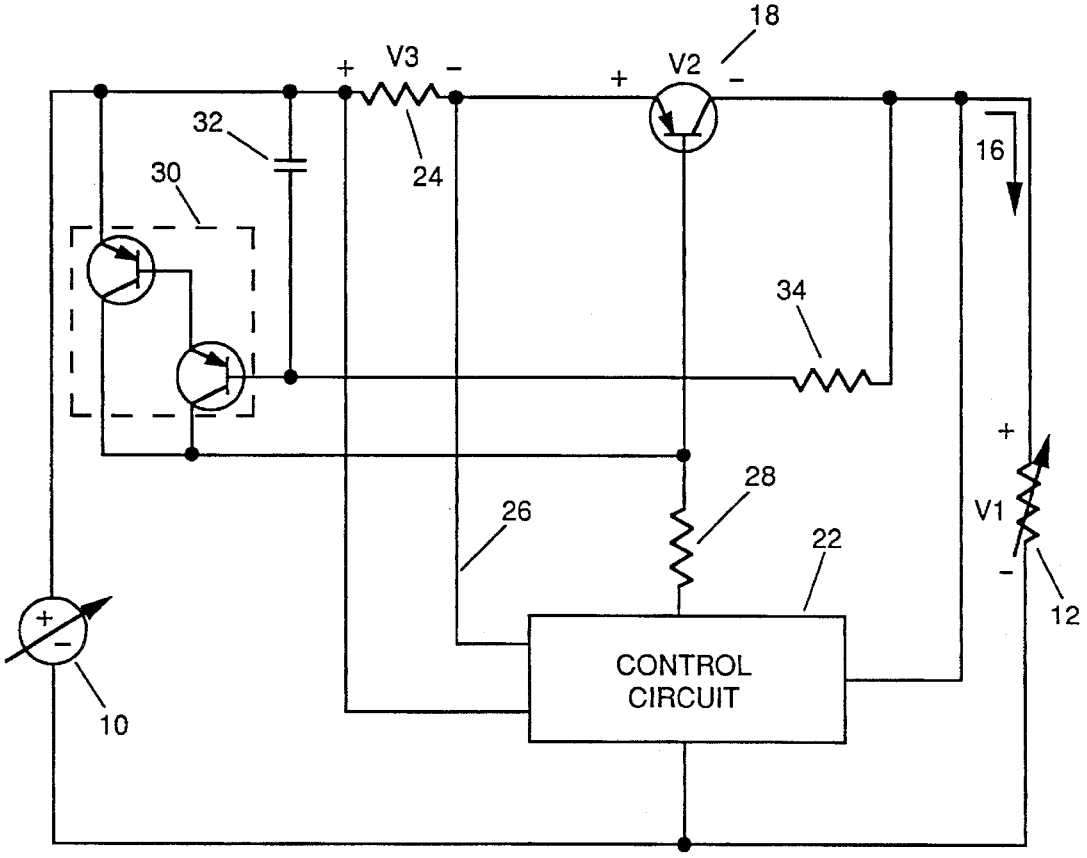
FIG. 1 (PRIOR ART)
FIG. 1 is a circuit diagram of a linear regulator including a shut off circuit, according to the prior art.

While the specification concludes with claims defining the features of the invention that are regarded as novel, it is believed that the invention will be better understood from a consideration of the following description in conjunction with the drawing figures, in which like reference numerals are carried forward.

Figure 2:
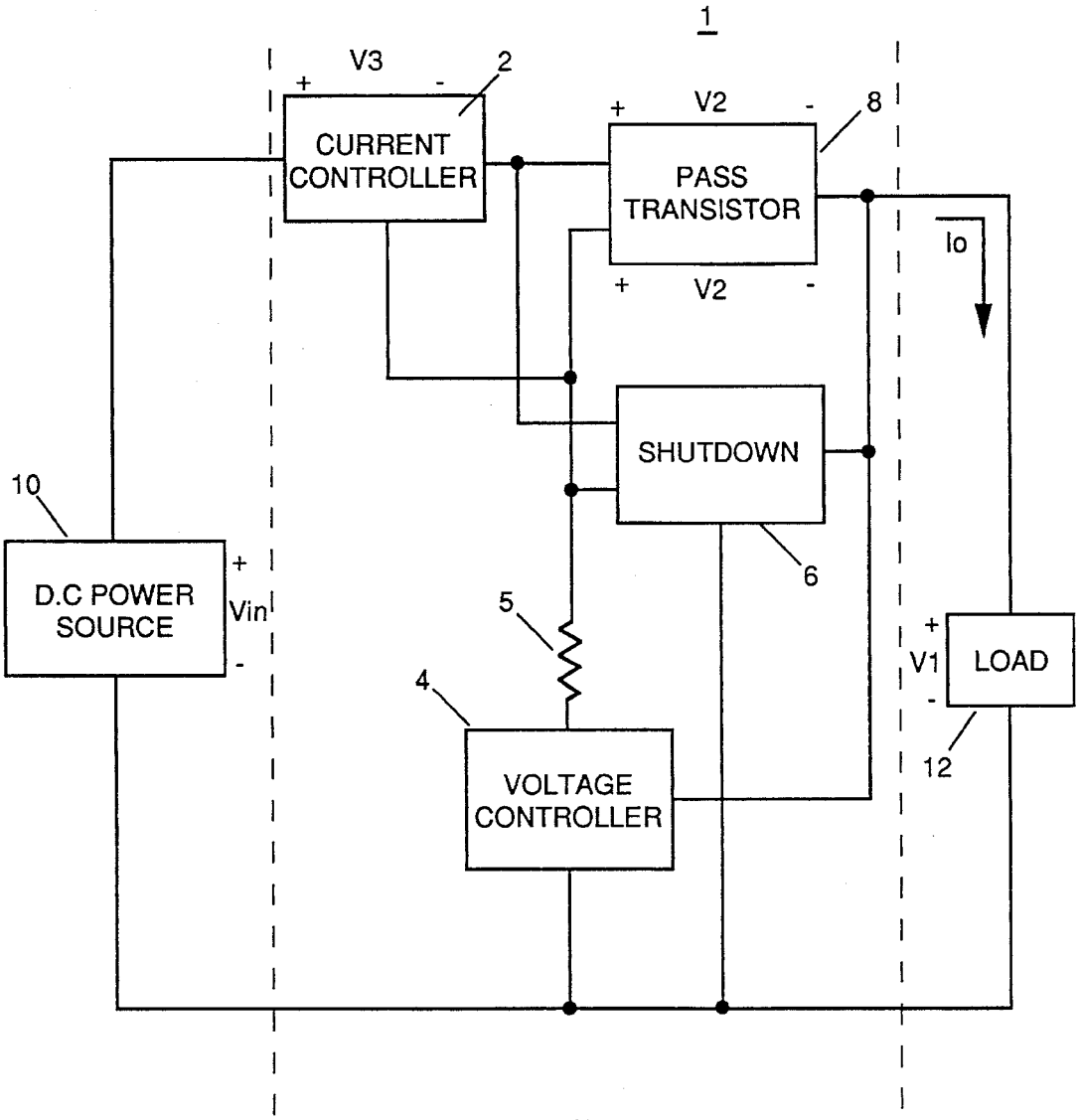
FIG. 2 is a block diagram illustrating a battery pack including a shut-off circuit in accordance with the instant invention.

Referring now to FIG. 2, there is illustrated therein a block diagram of a regulator circuit 1, including current controller 2, voltage controller 4, bias resistor 5, shutdown 6, and a pass device such as pass transistor 8. The regulator is disposed between a DC power source 10 and a load 12. Current flows to load 12 through pass transistor 8 and current controller 2 from unregulated DC source 10. Accordingly, voltage Vin of the power source 10 is divided across the load 12 as voltage V1, across pass transistor 8 as voltage V2, and across current controller 2 as voltage V3.

Current control 2 switches a control current signal into bias resistor 5 when the current level Io reaches a predetermined limit, causing pass transistor 8 to increase in effective resistance such that current Io is restricted to a preselected limit. Voltage controller 4 biases pass transistor 8 through bias resistor 5 to a state of effective resistance such that voltage V1 is maintained at a predetermined level, but yeilds control of pass transistor 8 to current controller 2. Shutdown 6 senses voltage V2 across pass transistor 8. When voltage V2 increases to a level where the power dissipation of pass transistor 8 reaches an unsafe level in response to the current demand of load 12, shutdown 6 switches off pass transistor 8 by applying a control signal to pass transistor 8. As a result, all of the source voltage appears at V2 and causes shutdown 6 to hold pass transistor 8 off until such time as load 12 is effectively disconnected.

Figure 3:
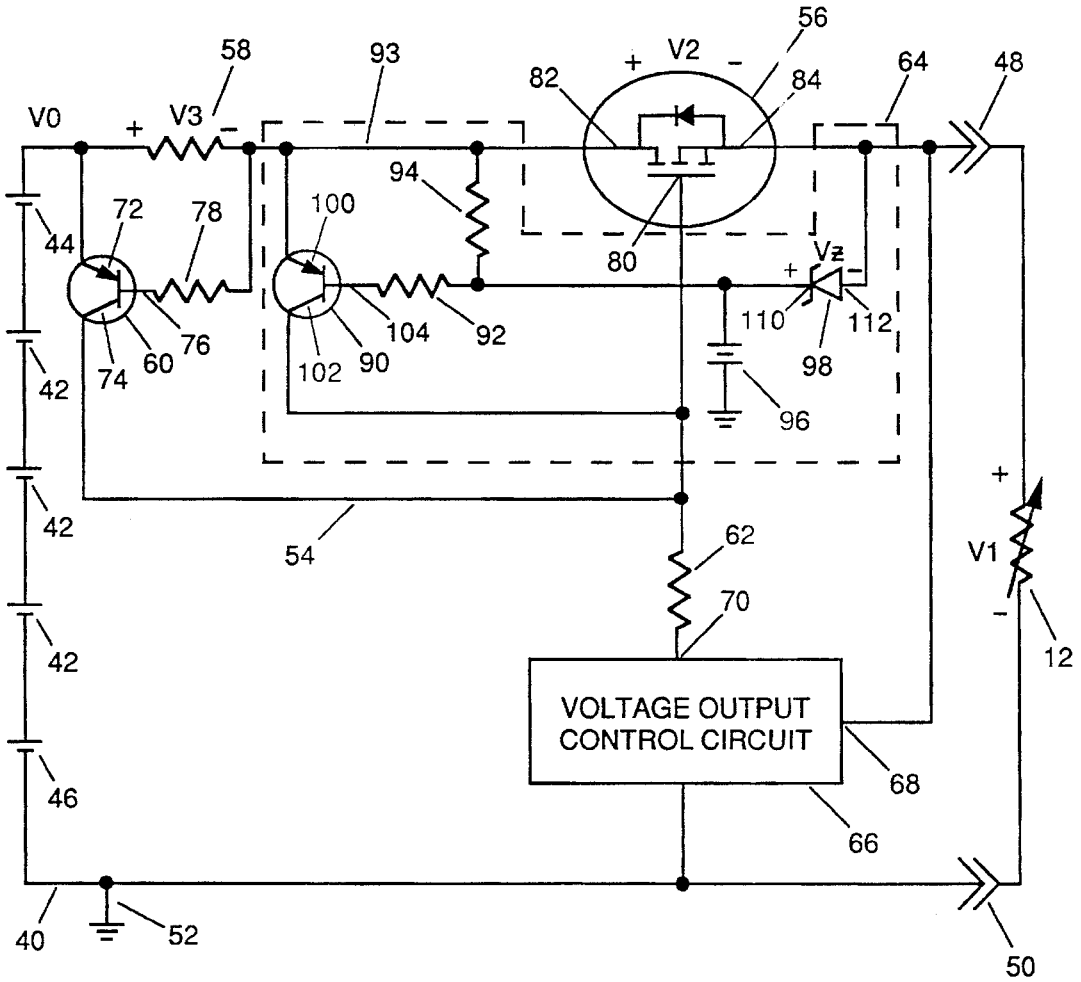
FIG. 3 is a circuit diagram of a battery pack having a linear regulator, and including a shut off circuit in accordance with the invention.

Referring now to FIG. 3, where there is illustrated therein a circuit diagram of a battery pack 40 including a linear regulator and a shutoff circuit, in accordance with the invention. Battery pack 40 includes battery cells 42, a positive battery terminal 44 and a negative battery terminal 46, for providing an output current and voltage V1 to load 12. Load 12 is connected to battery pack 40 via positive and negative contacts 48 and 50 respectively. Negative battery terminal 46 also provides a DC ground 52 reference voltage. Battery pack 40 further includes regulator circuit 54 which is comprised of pass transistor 56, sense resistor 58, switch transistor 60, bias resistance 62, and shutdown circuit 64. In one preferred embodiment output voltage V1 is regulated, and voltage output control circuit 66 is included to provide the necessary electrical bias to pass transistor 56, causing desired regulation by sensing the output voltage from input 68, connected to the output voltage. Such negative feedback control circuits are well known in the art.

In another preferred embodiment, where only current limiting is required, bias resistance 62 may be connected to negative battery terminal 46, and only a current limit action will be provided by the regulator circuit 54. Since the battery voltage is often very low to minimize the number of series cells required to power a device, only the output current Io of the battery is limited since even a small nickel-cadmium battery pack can source 10 amperes of current, and therefore limiting current restricts the total available power and reduces the chance that the battery may cause an accidental ignition of a volatile environment. Whether voltage control circuit 66 is present or not, where bias resistance 62 is connected is referred to as an output control node 70 and is either the output of the voltage control circuit 66 if voltage regulation is required, or a sufficiently negative, stable voltage such as the DC ground 52, depending on the embodiment employed.

The current limiting function is performed, in part, by the interaction of switch transistor 60 and sense resistance 58. Sense resistance 58 is selected such that voltage drop V3 across it is equal to the bias voltage of switch transistor 60 when the current through sense resistance 58 reaches the limit level, that is, the pre-selected maximum current level. Emitter 72 of switch transistor 60 is connected to one end of sense resistance 58, and base 76 of the switch transistor 60 is coupled to a second end of sense resistor 58 through base current limiting resistor 78. The purpose of base current limiting resistor 78 is to limit current through base 76 of switch transistor 60, should the transistor ever fail, and its value is low such that it has a negligible effect on the switch action of transistor 60. Collector 74 of switch transistor 60 is coupled between bias terminal 80 of pass transistor 56 and bias resistance 62. Sense resistance 58 is also connected to input terminal 82 of pass transistor 56. Output terminal 84 of pass transistor 56 is connected to contact 48, and bias terminal 80 is coupled to bias resistor 62. In one preferred embodiment the pass transistor 56 is a MOSFET. The source of the MOSFET acts as input terminal 82, the drain of the MOSFET acts as output terminal 84 and the gate acts as bias terminal 80.

Battery pack 40 further includes shutdown circuit 64 which includes a three terminal switch, such as shutdown transistor 90, a base resistance 92, a bypass resistance 94, a stabilizing capacitor 96, and a voltage controlled current blocking element, such as zener diode 98. The three terminal switch has first, second, and third terminals which correspond to the emitter, collector, and base of the bipolar transistor illustrated as the shutdown transistor 90. Emitter 100 of shutdown transistor 90 is connected to sense resistance 58. Base 104 of shutdown transistor 90 is connected to a first terminal of base resistance 92, and collector 102 is connected to bias terminal 80 of pass transistor 56. Base resistor 92 is connected to one end of stabilizing capacitor 96, cathode 110 of zener diode 98, and to bypass resistance 94. The other end of bypass resistance 94 is connected to sense resistance 58 and pass transistor 56. The other end of stabilizing capacitor 96 may be connected to any stable voltage, and is shown here connected to ground. Anode 112 of zener diode 98 is connected to contact 48. Voltage drop V2 across pass transistor 56 is sensed by the series arrangement of zener diode 98, base resistance 92, and shutdown transistor 90.

Since the output current is limited to a predetermined level, the voltage drop V2 at which pass transistor 56 reaches its maximum safe power dissipation level is easily calculated, considering the maximum current. If, for example, the maximum dissipation of pass transistor 56 is 2 watts, and the current is limited to 900 milliamps, then the maximum voltage drop V2 would be 4 volts when maximum current level output is reached, such as when the output of the regulator is shorted. In this example, the shutdown circuit needs to disable the regulator when 4 volts or more is apparent across pass transistor 56. Since the shut down transistor 90 will activate when it is at about 0.65 volts, zener voltage Vz of zener diode 98 is chosen as the complement of the maximum voltage for voltage drop V2. In this case Vz will be about 3.3 volts. Bypass resistance 94 allows enough current to bypass shutdown transistor to supply the leakage current of zener diode 98, which is typically much higher than the leakage current of shutdown transistor 90, and thereby avoids premature activation of shutdown transistor 90. Once activated, shutdown transistor 90 switches on and current flows to bias resistance 62, and overwhelms the bias of pass transistor 56. As a result, pass transistor 56 shuts off, and is not activated until the impedance of load 12 increases to a point where current does not flow through shutdown transistor 90, or the load 12 is removed. The purpose of stabilizing capacitor 96 is to provide a brief delay of the shutdown effect so that normal events, like turning on the load device, do not prematurely activate shutdown circuit 64.

Figure 4:
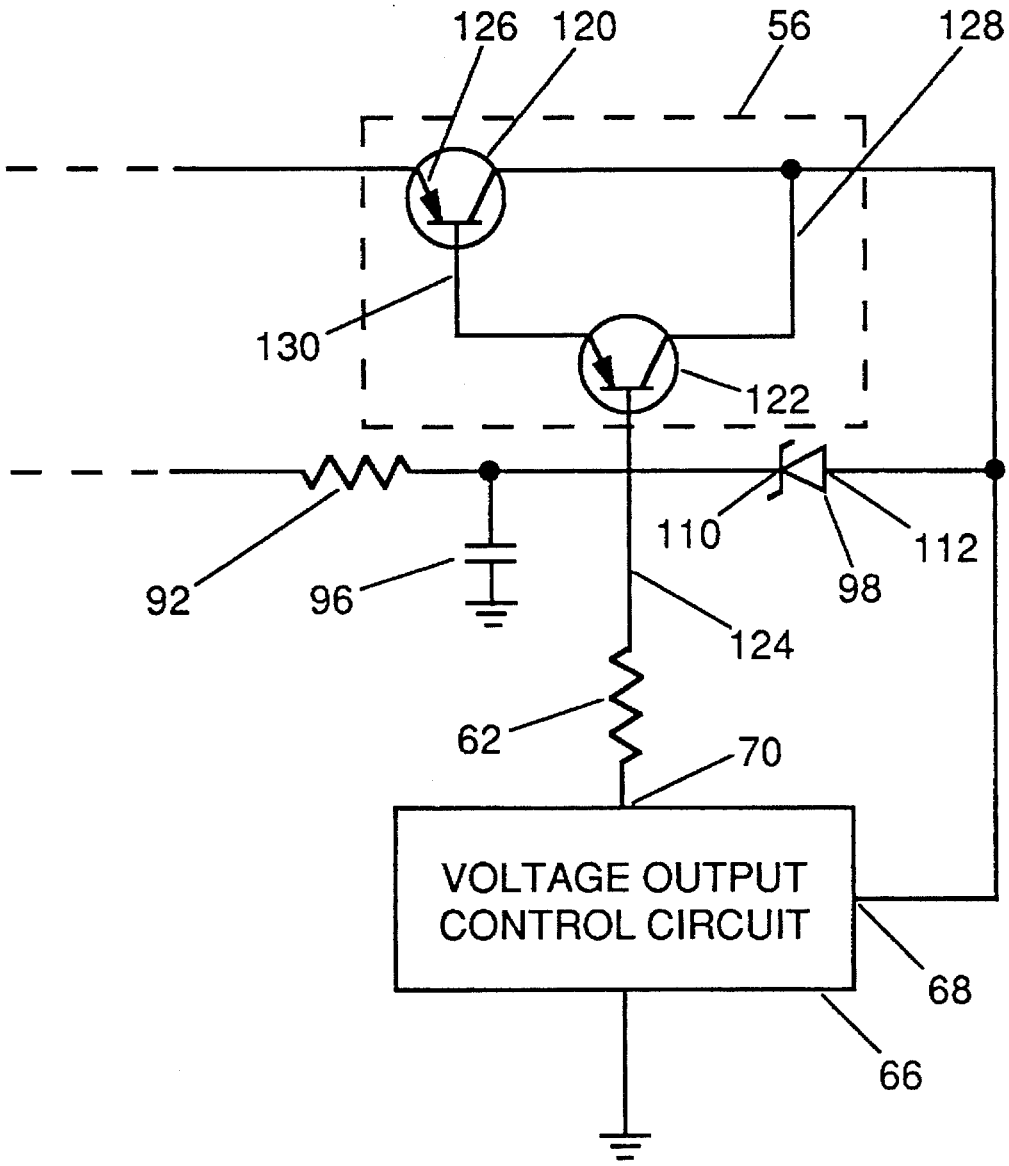
FIG. 4 is a circuit diagram of an alternate embodiment of a pass transistor, in accordance with the invention.

FIG. 4 shows an alternate embodiment of the instant invention, in which pass transistor 56 comprises a pair of bipolar transistors 120 and 122 connected in a darlington configuration to provide a high gain effective transistor. All other elements in FIG. 3 are present in the embodiment of FIG. 4, though may not be shown therein. The result produces an effective base 124, effective emitter 126, and effective collector 128. Current is drawn through bias resistance 62 by the control circuit 66 to control the bias of pass transistor 56. If the regulator is meant only to provide a very low current, a single bipolar transistor 120 may be used alone. In such a case, base 10 of transistor 120 would be connected to bias resistance 62, and transistor 122 would be omitted.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A shutdown circuit for use with a power source, a load, and a pass device having an input terminal, an output terminal, and a bias terminal, said shutdown circuit being disposed electrically in parallel with said pass device, said circuit comprising:

a three terminal switch having a first terminal connected to said input terminal of said pass device, a second terminal electrically coupled to said bias terminal of said pass device, and a third terminal connected to said output terminal of said pass device through a first resistance and a voltage controlled current blocking element.

2. A shutdown circuit as in claim 1, wherein said voltage controlled current blocking element is a zener diode.

3. A shutdown circuit as in claim 2, wherein said zener diode has an anode and a cathode, and said cathode is electrically coupled to the third terminal of said three terminal switch.

4. A shutdown circuit as in claim 1, wherein said three terminal switch is a bipolar transistor having a base, an emitter, and a collector, said base being said third terminal of said three terminal switch, said emitter being said first terminal of said three terminal switch, and said collector being said second terminal of said three terminal switch.

5. A shutdown circuit as in claim 1, further including a capacitor electrically coupled between said third terminal of said three terminal switch and a ground.

6. A shutdown circuit as in claim 1, further including a second resistance disposed between said first terminal and said third terminal of said three terminal switch.

7. A shutdown circuit having a pass device in series between an unregulated DC power source and an output, said pass device having an input terminal, an output terminal, and a bias terminal, said bias terminal electrically connected to a voltage control circuit, said shutdown circuit comprising:

a voltage sense means for sensing the voltage drop across said pass device, and electrically connected across said pass device from said input terminal to said output terminal; and a shutdown transistor for supplying current to said bias terminal of said pass device causing said pass device to shut off, said shutdown transistor having an emitter, a collector, and a base, said emitter being electrically connected to said input terminal of said pass device means, said collector being electrically connected to said bias terminal of said pass device, said base being electrically connected to said voltage sense means, and said base and said emitter forming a base-emitter junction.

8. A shutdown circuit as in claim 7, wherein said voltage sense means comprises:

said base-emitter junction of said shutdown transistor;

a base resistance having first and second terminals, said first terminal electrically connected to said base of said shutdown transistor; and a zener diode having an anode and a cathode, said cathode electrically connected to said second terminal of said base resistance, said anode electrically connected to said output terminal of said pass device.

9. A shutdown circuit as in claim 8, further comprising:

a bypass resistance electrically connected from said shutdown transistor emitter to said second terminal of said base resistance; and a capacitance electrically connected between said base of said shut down transistor and a ground.

10. A battery pack for powering a device, said battery pack having positive and negative output contacts for providing output voltage and current to said device, said battery pack comprising:

at least one battery cell, having a positive terminal and a negative terminal;

a pass device having an input terminal, an output terminal, and a bias terminal; and a shutdown circuit being disposed electrically in parallel with said pass device, said circuit comprising a three terminal switch having a first terminal connected to said input terminal of said pass device, a second terminal electrically coupled to said bias terminal of said pass device, and a third terminal connected to said output terminal of said pass device through a first resistance and a voltage controlled current blocking element.

11. A battery pack as in claim 10, wherein said voltage controlled current blocking element is a zener diode.

12. A battery pack as in claim 11, wherein said zener diode has an anode and a cathode, and said cathode is electrically coupled to the third terminal of said three terminal switch.

13. A battery pack as in claim 10, wherein said three terminal switch is a bipolar transistor having a base, an emitter, and a collector, said base being said third terminal of said three terminal switch, said emitter being said first terminal of said three terminal switch, and said collector being said second terminal of said three terminal switch.

14. A battery pack as in claim 10, further including a capacitor electrically coupled between said third terminal of said three terminal switch and a ground.

15. A battery pack as in claim 10, further including a second resistance disposed between said first terminal and said third terminal of said three terminal switch.

* * * * *